United States Patent [19]

Forté

[11] 4,140,218

[45] Feb. 20, 1979

[54] WRAP FOR POLYGONAL PRISM SHAPED ARTICLES

[75] Inventor: Robert L. Forté, Monroe, Mich.

[73] Assignee: Consolidated Packaging Corporation, Chicago, Ill.

[21] Appl. No.: 783,180

[22] Filed: Mar. 31, 1977

[51] Int. Cl.[2] ..... B65D 5/02; B65D 85/02

[52] U.S. Cl. ..... 206/303; 206/395; 206/806; 229/40

[58] Field of Search ..... 229/40, 52 B, 38, 39 R; 206/806, 303, 304, 491, 397, 446, 389, 311, 395, 408, 470, 471

[56] References Cited

U.S. PATENT DOCUMENTS

| | | | |
|---|---|---|---|
| 1,695,143 | 12/1928 | Drapeau | 229/38 |
| 1,806,149 | 5/1931 | Daugherty | 229/38 |
| 2,000,454 | 5/1935 | Peters | 221/45 |
| 2,953,245 | 9/1960 | Zastrow | 206/394 |
| 2,971,688 | 2/1961 | Akers | 229/38 |
| 3,033,362 | 5/1962 | Marcalus | 206/806 |
| 3,083,826 | 4/1963 | Weinstein | 206/316 |
| 3,261,537 | 7/1966 | Kistner | 229/40 |
| 3,587,840 | 6/1971 | Hultberg | 206/395 |
| 3,591,070 | 7/1971 | Vrana | 229/38 |
| 3,664,572 | 5/1972 | Puchkoff | 229/40 |
| 3,705,861 | 12/1972 | Rossi et al. | 229/40 |

FOREIGN PATENT DOCUMENTS

| | | | |
|---|---|---|---|
| 506065 | 5/1939 | United Kingdom | 206/395 |
| 527923 | 10/1940 | United Kingdom | 206/395 |

*Primary Examiner*—William T. Dixson, Jr.
*Assistant Examiner*—Allan N. Shoap
*Attorney, Agent, or Firm*—Hugh Adam Kirk

[57] ABSTRACT

A display wrapping of a single fiberboard type of sheet formed into an open-ended tubular type carton with display apertures in the sides thereof for displaying polygonal prism or annular disc-shaped articles such as wheels, tires, automobile air filters, and other cylindrical or tubular shaped objects. The wrap comprises one or more wrappings which have cut-out portions in at least two opposite side panels, and may have central apertures in two opposite side panels aligned with the aperture in the annular article being wrapped. These two opposite side panels are joined by straps at their four corners to expose the associated opposite segment sides of the article being wrapped. Opposite ends of the wrapping sheet are anchored together on the front or back panel either by dovetailed interfitting ends, or a flap with parallel opposing locking tabs that fit in corresponding parallel slots on the back panel. One or the top end of the back panel is provided with a double flap with an end tab, which flap can extend outwardly in the plane of the back panel and have an aperture for hanging the wrap and article, or which flap can be folded over the end of the carton as a cover.

29 Claims, 27 Drawing Figures

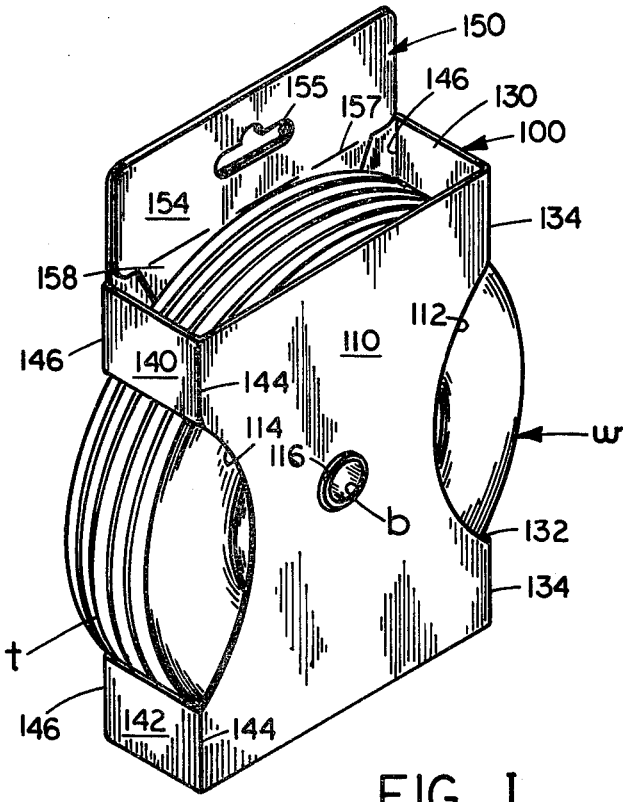
FIG. I
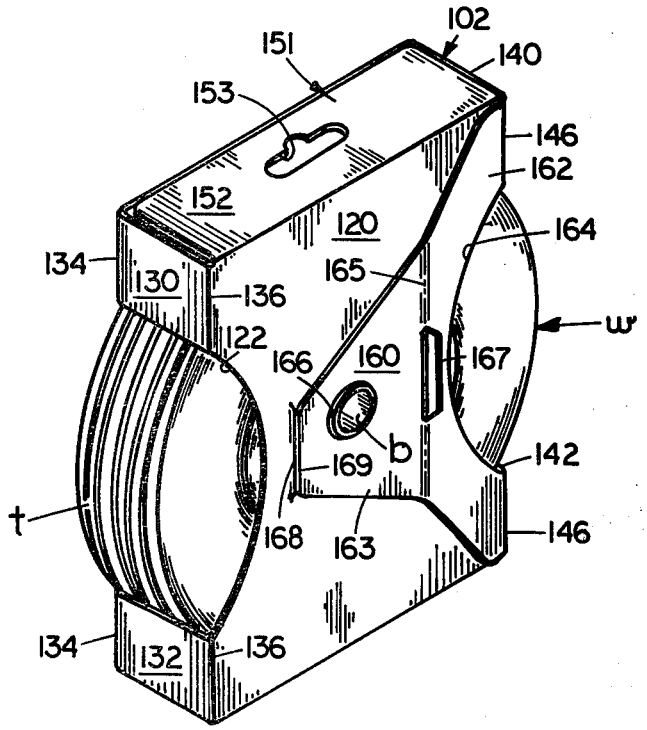
FIG. II

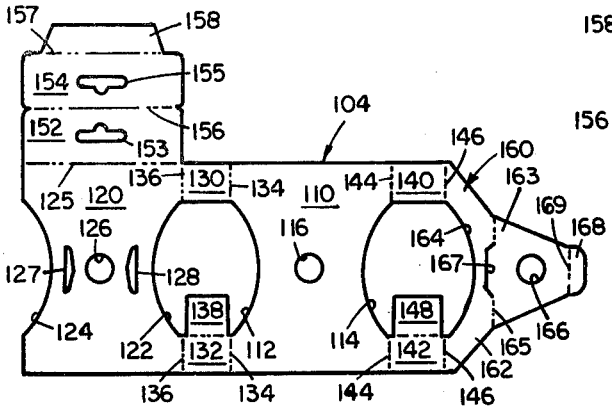
FIG. III
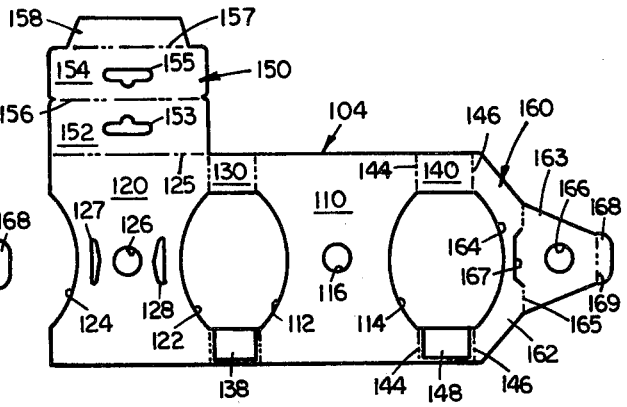
FIG. IV
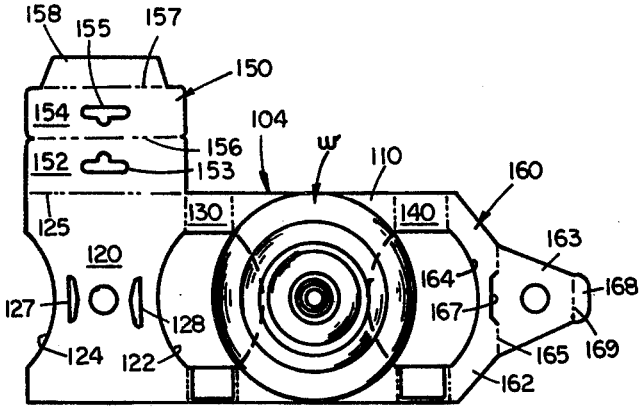
FIG. V
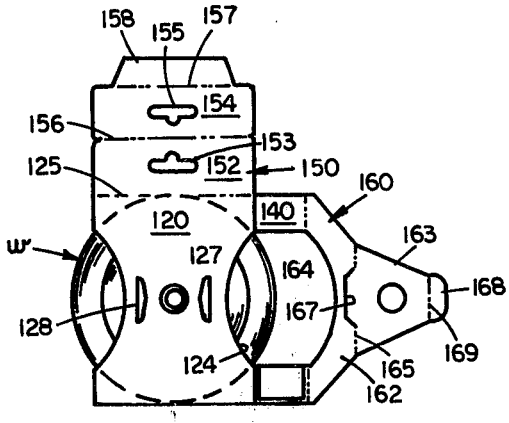
FIG. VI
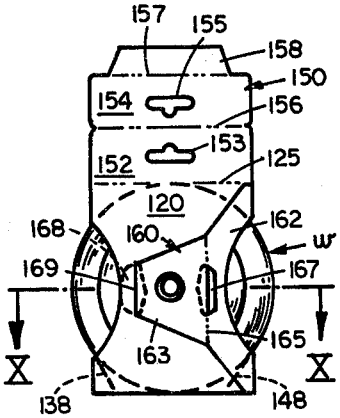
FIG. VII
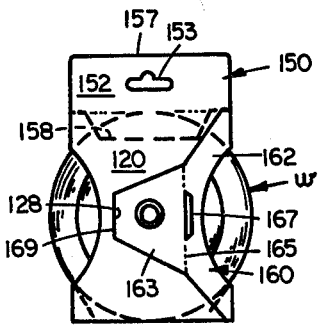
FIG. VIII
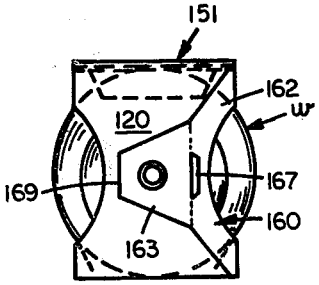
FIG. IX
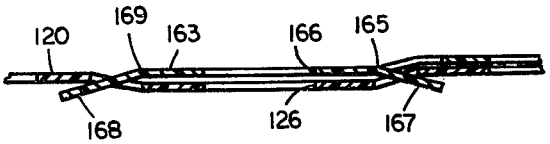
FIG. X

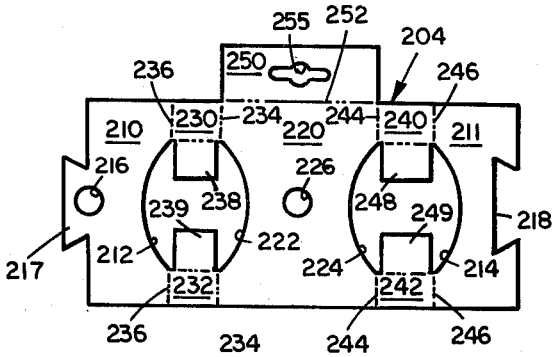
FIG. XI
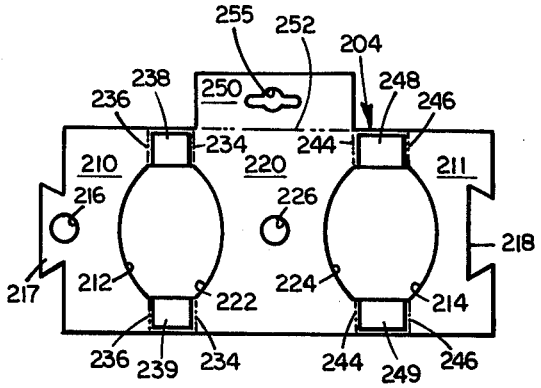
FIG. XII
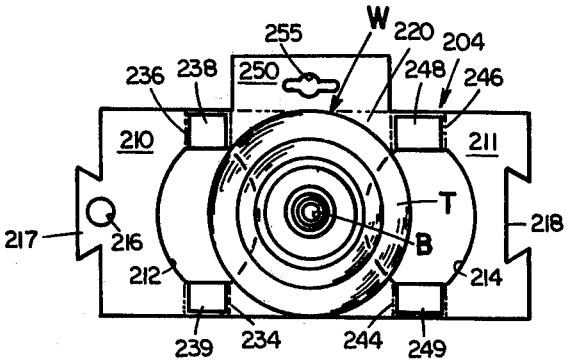
FIG. XIII
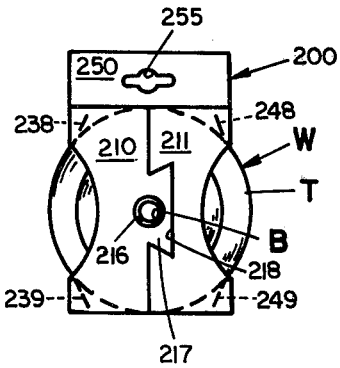
FIG. XIV

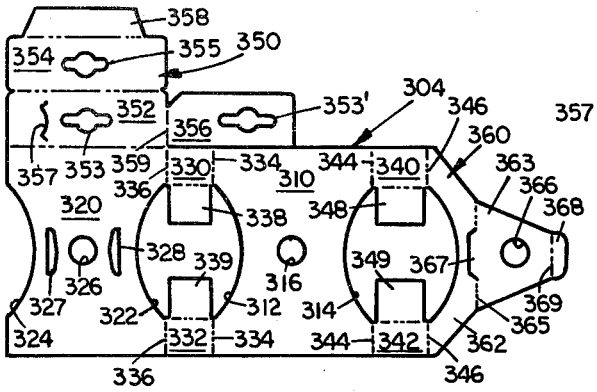
FIG. XV
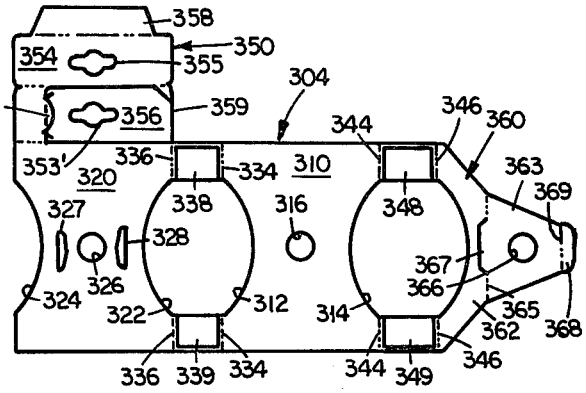
FIG. XVI
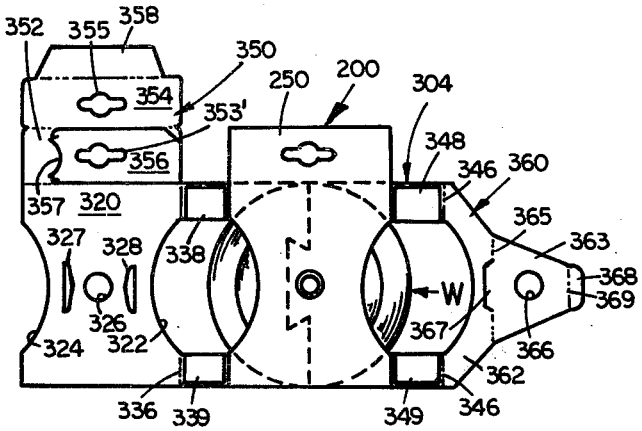
FIG. XVII
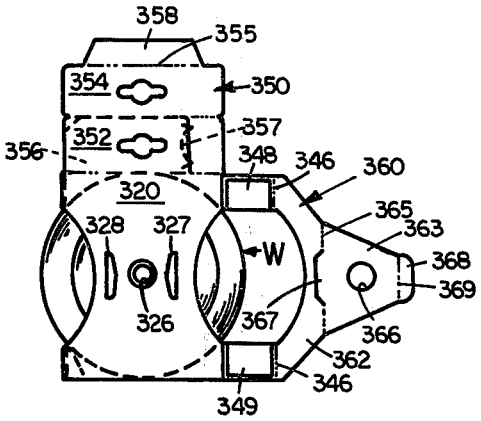
FIG. XVIII
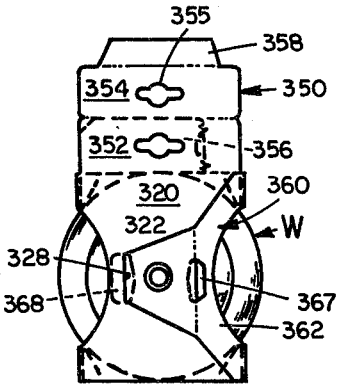
FIG. XIX
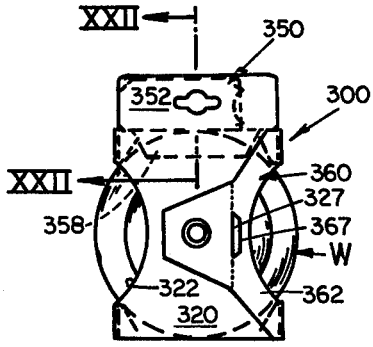
FIG. XX
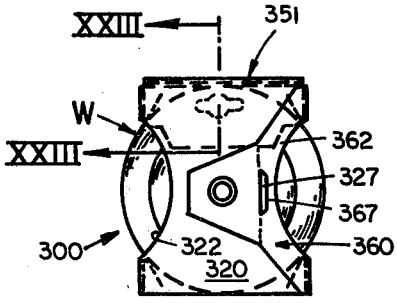
FIG. XXI
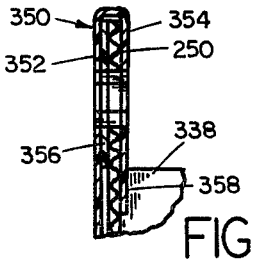
FIG. XXII
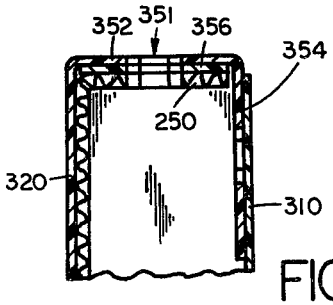
FIG. XXIII

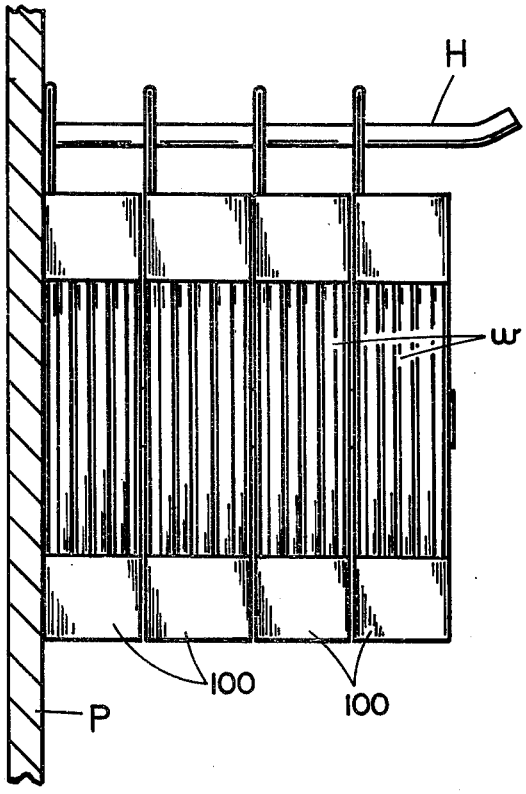
FIG. XXIV
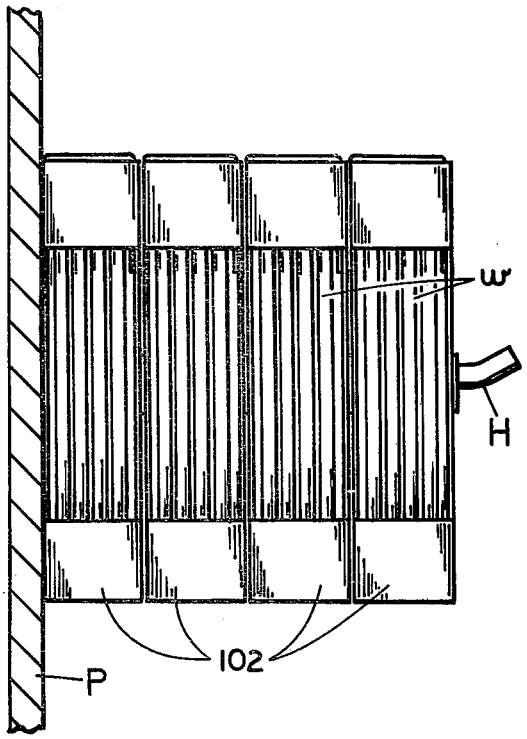
FIG. XXV
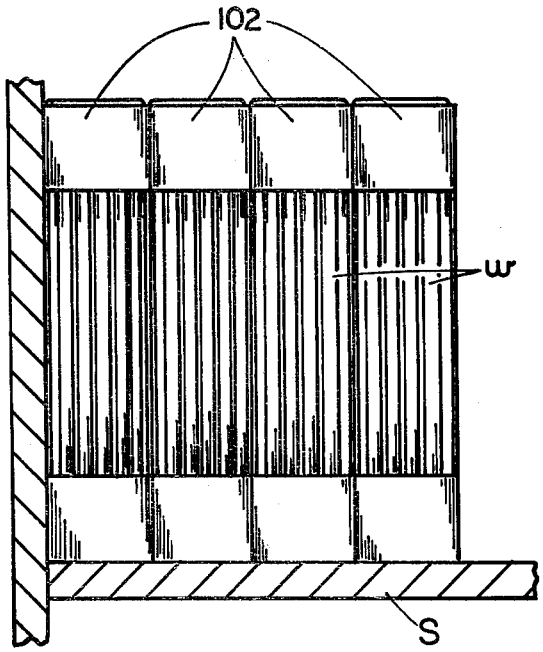
FIG. XXVI
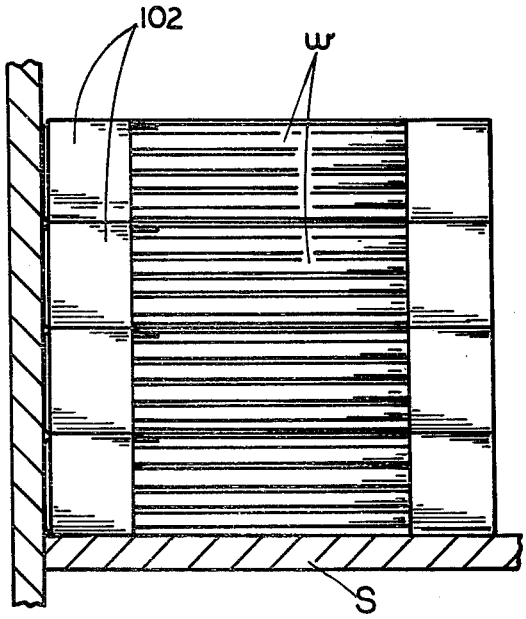
FIG. XXVII

WRAP FOR POLYGONAL PRISM SHAPED ARTICLES

SUMMARY OF THE INVENTION

Generally speaking, the hang-up, stand-up, lay-down, or stackable rectangular tubular wrapping package for prism shaped articles according to the present invention comprises a single blank of fiberboard type of sheet material which is cut and folded to form opposite side panels at the axial ends of the article whose edges are cut out to display part of the article; four side strips or straps between the corners of these two end panels; and a combination hanging or cover flap.

If the wrap is made of relatively thick fiberboard sheeting, such as corrugated board, the ends of the wrapping sheet may be cut out for edge abutment and dovetail interfitting and locking on the front or back panel. On the other hand, if the wrap sheet is made of thinner fiberboard material, an additional partial overlapping back side flap may be provided having cut-out portions congruent with the cut-out portions on the back panel and a pair of opposing locking tabs parallel to each other, such as on each side of the central aperture, if there is one, which tabs fit into correspondingly spaced slots or slits in the back panel.

The four corner side strips may be provided with flaps that extend over the peripheral surface of the article, either inside or outside of the tubular configuration of the wrap, at either or both ends thereof, as desired.

One of the ends of the back panel is provided with a flap which may be a double folded cover portion with an outer tab, which double portions also may be folded against each other and extend outwardly in the plane of the back panel to provide an outwardly extending hanger flap through which hanger flap there may be provided a notched-slot aperture by which the article and its wrap may be suspended from a hook for display. This hanger flap may be provided with an additional layer flap for reinforcement purposes in the event the article is relatively heavy compared to the strength of the fiberboard sheet of the wrapping material.

If the article to be wrapped is relatively heavy and/or large, it may be doubly wrapped first with a corrugated wrap with the dovetailed interfitting ends, and then this corrugated wrap may be wrapped around with a thinner fiberboard material with the parallel interlocking tabs on overlapped back portion or flap.

Objects and Advantages

Therefore, it is an object of this invention to provide a display carton for polygonal prism shaped articles including annular articles such as wheels for lawn mowers and automobile air filters, which carton can be hung from a top flap, strung on a hook, stood up or laid down, and also stacked compactly for storage and shipping.

Another object is to provide such a display carton which carton is simple, efficient, effective, economic, easy to assemble, requires no gluing, can be shipped flat and unfolded, provides space for advertising and printing thereon, as well as displaying at least 25% of the outer surfaces of the article it wraps or packages.

BRIEF DESCRIPTION OF THE VIEWS

The above mentioned and other features, objects, and advantages, and the manner of attaining them are described more specifically below by reference to embodiments of this invention shown in the accompanying drawings, wherein:

FIG. I the front, top and side perspective view of a lawn mower wheel wrapped in the display carton according to one embodiment of this invention;

FIG. II is a top, side and rear view of the wheel and its wrap that is shown in FIG. I with its hanger flap in its end covering position;

FIG. III is a plan view on a reduced scale of the unfolded blank of the wrap or display carton shown in FIGS. I and II;

FIG. IV through FIG. IX are successive views of how the blank in FIG. III is folded around the wheel as shown in FIGS. I and II;

FIG. X is an enlarged sectional view taken along line X—X of FIG. VII showing the interlocking of locking tabs on the partial back flap into the back panel.

FIG. XI is a plan view of the unfolded blank of another embodiment of a wrap according to this invention made out of a thicker sheet material, such as corrugated fiberboard, which may be used as an inner wrap for a larger wheel or polygonal prism shaped articles;

FIG. XII through FIG. XIV show steps in wrapping the blank shown in FIG. XI around a larger wheel as an inner wrap, which inner wrap may then be wrapped with an outer wrap as shown in the blank of FIG. III or in the following further embodiment of a similar wrap as shown in FIG. XV;

FIG. XV is a plan view of the unfolded blank of still another embodiment of this invention showing an additional pair of flaps on the corner straps and an additional end flap on the hanging flaps for reinforcement thereof;

FIG. XVI through XXI show the stages in wrapping the embodiment of FIG. XV with added flaps for strength for better supporting the heavier blank and wheel shown in FIG. XIV, which strengthened the outer blank of FIG. XV is wrapped around the wheel containing the wrap as shown in FIG. XIV;

FIG. XXII is an enlarged sectional view taken along line XXII—XXII of FIG. XX showing the reinforcing and the hanging flap for this display carton;

FIG. XXIII is an enlarged section taken along line XXIII—XXIII of FIG. XXI showing the folding-over of the hanger flap as a cover for one end of the carton;

FIG. XXIV is a side elevation view of a hook on a display panel for hanging a plurality of the wheels wrapped in the display cartons shown in FIGS. I and II FIG. XXV is a side elevational view similar to FIG. XXIV showing the same cartons being strung on a hook through the hollow axles of the wheels in the cartons with their hanger flaps folded over as covers for the ends of the cartons;

FIG. XXVI shows the same cartons for wheels as displayed in FIG. XXV being stood up on a shelf; and FIG. XXVII shows the same cartons for wheels as displayed in FIGS. XXV or XXVI being stacked on a shelf, or as they could be stacked in a shipping carton.

DETAILED DESCRIPTION OF THE PREFERRED EMBODIMENTS

A. Lighter-Weight Wrap

In FIGS. I and II are shown two forms of one of the embodiments of the article wrap or tubular carton 100 and 102 with the hanger flap 150 up and closed as an end cover 151, respectively. In each form the wrap is displaying a lawn mower wheel w which has a tire t mounted thereon and which has a central shaft receiving hollow bearing b. Generally speaking, each form of the wrap or carton 100 and 102 comprises a front panel 110, a rear panel 120, corner side straps 130, 132, 140, and 142, connecting the front and back panels 110 and 120 along their upper and lower sides at their corners; a hanging flap cover 150; and in this embodiment an overlapping locking flap or partial back panel 160 for locking engagement with the back panel 120.

More specifically, each of these portions of the tubular carton or wrap 100 or 102 are folded together from a single piece blank 104 as shown in FIG. III and each of these panels have the following specific features which enable it not only to display the article that it is to contain, but also to ensure its maintenance in the container. Thus the front and back panels 110 and 120 are each provided herein with segment shaped cut-out portions 112 and 114 and 122 and 124, respectively, and also may have central apertures 116 and 126 which align with the central aperture in the bearing b in the wheel w being wrapped. Hinged between the upper and lower sides of the front and back panels 110 and 120 are side corner connecting straps or strips 130 and 132, connected along fold lines 134 and 136, respectively, to panels 110 and 120. In this embodiment, the opposite side straps or strips 140 and 142 are hinged along fold lines 144 to the other side of the front panel 110, and on their opposite sides by fold lines 146 to the overlapping partial back or locking panel section 160. If desired, the blank may also be provided with inwardly folding flaps 138 and 148 connected to the straps 132 and 142, respectively, which flaps may be folded outwardly or inwardly as shown in FIG. VII for engagement with the peripheral surface of the article being packaged and aid in the support of the article in the wrap.

This partial panel or section 160 may be provided with a panel portion 162 which has an arcuate cut-out portion 164 similar and congruent to the portions 114 and 124, which panel only extends partially across the back panel 120 when wrapped thereover. This panel 162 is provided with a tab section 163 with a central aperture 166 aligned with the apertures 126 and 116. This section 163 is provided with a fold line 165 having a locking tab 167 and an outwardly extending locking tab 168 joined by a fold line 169 to the section 163. Thus there are provided two parallel opposite extending locking tabs 167 and 168 which will lock into locking slots 127 and 128 provided in the back panel 120 as will be described later in FIGS. VII and X below.

Referring further to FIG. III there is shown attached to the upper top or one end edge of the back panel 120 by means of fold line 125, a pair of cover or hanger flaps 152 and 154, each of which may be provided with aligned apertures 153 and 155, which apertures may comprise elongated slots with notches therein as shown. These flaps 152 and 154 are connected together by fold line 156, and the outer panel 154 may be connected to an outwardly extending flap 158 connected thereto by a hinge or fold line 157.

Referring now to the assembly of the wrap shown in FIG. III around a wheel w as shown in FIGS. I and II, first the blank 104 has its tabs 138 and 148 folded back over the panels 132 and 142, respectively, as shown in FIG. IV. Then the wheel w is laid over the back side of the front panel 110 as shown in FIG. V. Next, the back panel 120 is folded over the top of the wheel w as shown in FIG. VI so that its central aperture 126 is in alignment with the aperture in the wheel bearing b and the aperture 116 in the front panel. Lastly, the overlapping locking panel 160 is folded over the back panel 120 so that the locking tab 167 will fit into the locking slot 127 in the now folded-over back panel 120, and then the locking tab 128 at the end of the section 160 is inserted into the locking slot 128 to anchor the wrap into its tubular form around the wheel w. The tab 167 prevents the section 160 from returning to the position shown in FIG. VI, while the tab 128 maintains the flap section 163 into flat overlapping engagement with the back panel 120 as shown in FIGS. II, VII, and VIII and IX.

Next, the hanging or cover flaps 150 are folded together along their intermediate fold line 156 so they overlap each other as shown in FIG. VIII with their outer tab 158 inserted behind the wheel w (see FIG. I) so as to maintain a double thickness of the tab 150 for reinforcing purposes when the whole package is hung upon a hook for display purposes. The cut-out portions in the sides of the front and back panel and the side strips 130, 132, 140, 142, enable a relatively large cylindrical sector portion of the wheel w and particularly the tire portion t to be exposed or displayed. However, if the article is not to be hung, but is to be packaged or stood up or laid down on a shelf, the flap portion 150 can be folded downwardly over the top of the wheel w as shown in FIG. IX and the flap 154 and its outer tab 158 may be tucked in on the other side of the wheel w to form a cover 151 for the package (see also FIG. II).

B. Heavier-Weight or Inner Wrap

Referring to FIGS. XI through XIV there is shown another embodiment of the wrap of this invention made out of a thicker sheet of material such as corrugated fiberboard, the blank 204 of which is shown in FIG. XI. This blank 204 comprises a back panel 220, divided front panel sections 210 and 211, and connecting side corner straps 230, 232, 240, 242, and a hanger flap 250. Specifically, the back panel 220 is provided with arcuate cut-out side portions 222 and 224 and may have a central aperture 226. At the upper and lower corner portions on one side of the panel 220 are fold lines 234 connecting the side strips 230 and 232, and on the opposite side of panel 220 are fold lines 244 connecting the side strips 240 and 242. The other ends of each of these side strips are fold lines 236 and 246 which connect the separate front panel sections 210 and 211, respectively. Also, each of these side strips 230, 232, 240 and 242 may be provided with hinged flaps 238, 239, 248 and 249, respectively, for engaging the peripheral surface of the larger wheel W which is to be wrapped in this blank 204 as shown in FIG. XIV. This wheel W has a tire T and a central bearing portion B with an axial aperture therein.

The front panel section 210 is provided with a central aperture 216 and a dovetail extension 217, while the opposite end of the blank 204 for the other front panel section 211 is provided with a dovetailed notch 218 for interfitting and locking with the extension 217 as shown in FIG. XIV. The two front panel sections 210 and 211 are also provided with arcuate cut-out portions 212 and 214, respectively, corresponding to the cut-outs 222 and 224.

In assembling the large wheel W in the blank 204 shown in FIG. XI, the first step is to fold back each of the tabs 238, 239, 248, 249 as shown in FIG. XII and then lay the wheel W over the back panel 220 as shown in FIG. XIII. Then the two end or front panel sections 210 and 211 are folded together so that their complimentary dovetailed projection 214 and notch 218 will interfit throughout the thickness of the corrugated fiberboard where the outer end edges of these panel sections abut as shown in FIG. XIV to form the package or display carton 200. Herein the hanger or cover flap 250 is also provided with a central aperture 255 which may be used for hanging the article on a display hook. This flap 250 also may be folded along fold line 252 to cover one end of the carton 200 for piling or stacking as shown in FIGS. XXI and XXII described later.

Thus, a simpler form of wrap can be used if a thicker sheet or board is employed, or this thicker wrap may be used as a cushion and/or a stronger support for wrapping the article and it in turn may be further wrapped with a thinner sheet of fiberboard similar to that shown in FIG. III or with a sheet having additional reinforcing flaps and/or tabs as shown in the next embodiment of FIG. XV.

C. Double Wrap

Referring now to FIG. XV there is shown another embodiment of a blank 304 similar to that in FIG. III, but with additional tabs upon the side straps and an additional reinforcing flap for the hanger flaps. Specifically, the front panel 310 may be provided with a central aperture 316 and side arcuate cut-out segments 312 and 314. The back panel 320 is similar to that of panel 120 in FIG. III with a central aperture 326, side cut-out portions 322 and 324, and parallel locking tab engaging slots 327 and 328. The intermediate connecting side corner strap sections 330 and 332 between the panels 310 and 320 are provided with corresponding fold lines 334 and 336, and also with inwardly extending folding flaps 338 and 339, similar to those of 238 and 239 disclosed in FIG. XI. At the opposite side of the front panel 310 there are hinged the other opposite side corner straps 340 and 342, each of which are provided with additional inwardly extending flaps 348 and 349, similar to flaps 338 and 339 just described. These straps 340 and 342 are hinged to the front panel by fold lines 344 and to the overlapping back part or locking tab extension flap 360 by fold lines 346 to partial panel section 362, which is connected by fold lines 365 to central flap section 363. This central flap section 363 may have a central aperture 366, and has an outer extending locking tab 368 connected thereto by fold line 369. This locking tab 368 is opposite the inwardly extending parallel locking tab 367 cut out along fold line 365, which locking tabs 367 and 368 are similar to those shown and described above in connection with FIGS. III, VII and X.

This blank 304 also is provided with the hanger and/or cover flap section 350 or 351, respectively, composed of the double folded-together flaps 352 and 354 which have central apertures 353 and 355 similar to that described for the blank 104 shown in FIG. III. However, in this embodiment there is also a further strengthening or reinforcing flap 356 which is hinged to the flap 352 along fold line 359. This additional reinforcing flap 356 may be shorter in length than the flaps 352 and 354 so that its outer edge can engage a holding tab 357 cut out of the flap 352 on the opposite side of the aperture 353 from the fold line 359. The flap 356 is also provided with a central aperture 353' which aligns with the hook engaging apertures 353 and 355.

Considering the blank shown in FIG. XV as a second wrap around a corrugated wrap 200 for article W shown in FIG. XIV, the first thing that is done is to fold back the peripherial engaging flaps 338, 339, 348, 349, and also fold in the additional reinforcing flap 356 over the flap 352 and lock its outer end under the tab 357 pushed up from the flap 352 as shown in FIG. XVI. The next step is to lay the previously wrapped article or wheel W in the carton 200 shown in FIG. XIV over the back of the front panel 310 as shown in FIG. XVII. Then fold the back panel 320 over the top of the package 200 as shown in FIG. XVIII. Next, the locking flap or partial overlapping back panel section 360 is folded over so that its locking tabs 368 and 367 engage the slots 328, 327, respectively, in the back panel 320 as shown in FIG. XIX and as described for the wrap 104 in FIGS. VI, VII, and X. Next the hanger flap 354 is folded down over the hanger flap 250 as shown in FIG. XX, similar to that shown and described in combination with FIG. VIII previously, but in this case there are four plies of material in the hanger section 350 as shown in FIG. XXII. Also, if the wrapped article 300 is to be stacked, the hanging flaps 350 can be folded over the top of the carton 300 as a cover 351 for one end thereof as shown in FIG. XXI, a cross-section of which is shown in FIG. XXIII showing how the outer flaps 354 and its outer tab 358 may be tucked inside the front panel 310.

The single wrap or blank shown in FIGS. XV and XVI is slightly different from that shown in the first embodiment of FIGS. III through X, in that it contains an additional hanging flap member 356 as well as additional wheel engaging flaps 338 and 348, because it must be stronger in order to support the larger wheel which is pre-wrapped in a corrugated blank, namely that wheel wrapped with the embodiment shown in FIGS. XI through XIV. This wrapped wheel is not placed in or on the embodiment of the blank shown in FIGS. XV and XVI until the tabs above mentioned, namely 356 and 338 and 348, have been folded over so that the completedly wrapped article in the corrugated blank shown in FIG. XIV can be placed on the blank as shown in FIG. XVII. Then the combination of both wrapping may continue according to the steps shown in FIGS. XVIII through XXI.

It is to be understood that the wrap 304 shown in FIG. XV may be used for smaller articles and as a single wrap. Also the size of the panels and side strips of the wraps may be longer, shorter, and different shaped and size than shown for fitting other shaped and sized polygonal articles.

In any event, the particular carton embodiments shown in this invention are readily adaptable for display purposes and for packaging for shipping, in that in the forms shown in FIGS. I, VIII, XIV, and XX, they may be displayed on a hook H as shown in FIG. XXIV extending from a display panel P. Furthermore, if desired, they can be strung through their center apertures on the same hook H as shown in FIG. XXV. If the packages have their hanger flaps 150, 250 or 350 folded down in the position 151 or 351 as shown in FIGS. II, IX, and XXI, they may be stood up on end on a shelf S as shown in FIG. XXVI, or they may be laid down and stacked on the shelf S as shown in FIG. XXVII, or similarly stacked in a carton for easy shipping.

It is to be understood that the single blank from which the different embodiments of the tubular type carton of this invention are made, may be formed of other materials than fiberboard which could be used for packaging, namely plastic or the like, or other reinforced sheet material which has sufficient rigidity to hold itself in position as do the fiberboard sheet panels shown herein.

While there is described above the observed principles of this invention in connection with specific apparatus, it is to be clearly understood that this description is made only by way of example and not as a limitation to the scope of this invention.

I claim:

1. A single sheet tubular display wrapping for a polygonal prism-shaped article comprising:
(A) a single first panel for one of two opposite parallel sides of said article having concave cut-out side edges,
(B) a single second panel equal in size and peripheral shape to said first panel for the other one of said two parallel sides of said article having concave cut-out side edges,
(C) side strips between said first and second panels at the outer ends of said cut-out side edges bridging the axial length of said article,
(D) an extended flap on one of said panels between said side strips adaptable for hanging said wrapping and article or for covering the adjacent open side of said wrapping, and
(E) means for locking opposite ends of said sheet together on one of said panels.

2. A wrapping according to claim 1 wherein said extended flap has an aperture therein for engagement with a hook means.

3. A wrapping according to claim 1 wherein said locking means comprises an interlocking tab and notch.

4. A wrapping according to claim 1 wherein said locking means comprises an end flap overlapping one of said panels having a pair of parallel opposing locking tabs for locking engagement with parallel slits on said one panel.

5. A wrapping according to claim 1 including a second similar inner wrapping for said article.

6. A wrapping according to claim 5 wherein said inner wrapping sheet is a corrugated fiberboard.

7. A wrapping according to claim 1 wherein at least one of said side strips is provided with an inwardly extending flap for engaging the peripheral surface of said article.

8. A wrapping according to claim 7 wherein each of said side strips has an inwardly extending periphery engaging flap.

9. A single sheet tubular display wrapping for a polygonal prism-shaped article comprising:
(A) a first panel for one of two opposite parallel sides of said article having concave cut-out side edges,
(B) a second panel for the other one of said two parallel sides of said article having concave cut-out side edges,
(C) side strips between said first and second panels at the outer ends of said cut-out side edges bridging the axial length of said article,
(D) an extended flap on one of said panels between said side strips adaptable for hanging said wrapping and article or for covering the adjacent open side of said wrapping, said extended flap comprising a central fold line and an outer tuck tab whereby said flap is foldable against itself and said tuck tab extends inside the adjacent side of said wrapping, and
(E) means for locking opposite ends of said sheet together on one of said panels.

10. A wrapping according to claim 9 including an additional hinged flap foldable between said folds of said extended flap.

11. A wrapping according to claim 10 including means for locking said additional hinged flap to its adjacent flap.

12. A single sheet tubular display wrapping for an annular-shaped article comprising:
(A) a front panel for one axial end of said article having
(1) concave cut-out side edges, and
(2) a central aperture,
(B) a back panel for the other axial end of said article having
(1) concave cut-out side edges,
(2) a central aperture, and
(3) an end flap having an aperture therein for engagement with a hook means, said end flap comprising a central fold line and an outer tuck tab whereby said end flap is foldable against itself and said tuck tab extends inside the adjacent side of said wrapping,
(C) side strips between said front and back panels at the outer ends of said opposite cut-out side edges bridging the axial length of said article, and
(D) means for locking opposite ends of said sheet together on one of said panels.

13. A wrapping according to claim 12 wherein said end flap is foldable over as a cover for the adjacent side of said wrapping.

14. A wrapping according to claim 12 including an additional hinged flap foldable between said folds of said end flap.

15. A wrapping according to claim 14 including means for locking said additional hinged flap to its adjacent end flap.

16. A single sheet display wrapping for an article having a polygonal peripheral surface, a pair of axially spaced parallel ends and an axial hole therein, said wrapping comprising:
(A) a front panel for one end of said article having a central aperture,
(B) a back panel for the other end of said article having a central aperture,
(C) side strips between said front and back panels adjacent the corners of their opposite sides bridging the axial thickness of said article,
(D) a pair of top end flaps and tuck tab hinged to the top of said back panel, said flaps having aligned apertures when folded together and said tuck tab extends inside the adjacent side of said back panel, said apertures being for engagement with a hook for supporting said wrapping and article, and
(E) means for locking opposite ends of said sheet together on one of said panels.

17. A wrapping according to claim 16 wherein said front and back panels have cut-out portions in their sides between said side strips.

18. A wrapping according to claim 16 wherein said end flap is foldable over as a cover for the adjacent side of said wrapping.

19. A wrapping according to claim 16 including an additional hinged flap foldable between said end flaps.

20. A wrapping according to claim 19 including means for locking said additional hinged flap to its adjacent end flap.

21. A wrapping according to claim 16 including a second similar inner wrapping for said article.

22. A wrapping according to claim 21 wherein said inner wrapping sheet is a corrugated fiberboard.

23. A wrapping according to claim 16 wherein at least one of said side strips is provided with an inwardly extending flap for engaging the peripheral surface of said article.

24. A wrapping according to claim 23 wherein each of said side strips has an inwardly extending periphery engaging flap.

25. A wrapping according to claim 16 wherein said locking means comprises an end flap overlapping said back panel having a concave cut-out side edge, and a pair of parallel opposing locking tabs for locking engagement with parallel slits on said one panel.

26. A display single sheet fiberboard wrapping for an annular disc-shaped article comprising:

(A) a front panel for one side of said disc having
  (1) concave cut-out side edges, and
  (2) a central aperture,
(B) a back panel for the other side of said disc having
  (1) concave cut-out side edges,
  (2) a central aperture, and
  (3) parallel locking tab engaging slits on opposite sides of said central aperture,
(C) side strips between the front and back panels adjacent the corners of said cut-out side edges bridging the axial thickness of said disc,
(D) a lock end flap panel partially overlapping said back panel having
  (1) a concave cut-out side edge,
  (2) an aperture aligned with said central apertures, and
  (3) a pair of opposing locking tabs on opposite sides of said aperture for locking engagement with said locking tab engaging slits on said back panel, and
(E) a pair of top end flaps and outer tuck tab hinged to the top of said back panel, said flaps having aligned apertures when folded together and said tuck tab extends inside an adjacent side of said back panel, said apertures being for engagement with a hook for suspending said wrapping and its article for display thereof.

27. A wrapping according to claim 26 including at least a pair of inwardly foldable flaps on at least said bottom pair of side strips for engagement with the periphery of said disc in said wrapping.

28. A wrapping according to claim 26 wherein said pair of top end flaps includes a third flap hinged to the end of one of said top end flaps and having a central aperture, said third flap being sandwiched between said pair of flaps.

29. A wrapping according to claim 28 including means for anchoring said third flap to its adjacent hinged flap.

* * * * *